United States Patent [19]

Bailey et al.

[11] 3,996,697

[45] Dec. 14, 1976

[54] DOOR OPERATOR WITH SCREW DRIVE

[75] Inventors: Morris W. Bailey, Fort Worth; Donald S. Harris; Nesbitt A. Boyles, both of Dallas, all of Tex.; Victor Sumnicht, Appleton, Wis.

[73] Assignee: Overhead Door Corporation, Dallas, Tex.

[22] Filed: Dec. 24, 1975

[21] Appl. No.: 644,193

[52] U.S. Cl. ..... 49/28; 49/139; 49/362; 318/266

[51] Int. Cl.[2] ..... E05F 15/10

[58] Field of Search ..... 49/26, 28, 360, 362, 49/139; 318/266, 467, 468

[56] References Cited

UNITED STATES PATENTS

| | | | |
|---|---|---|---|
| 2,253,170 | 8/1941 | Dunham | 49/28 |
| 2,882,045 | 4/1959 | Moore | 49/28 |
| 2,991,406 | 7/1961 | Seith et al. | 49/28 |
| 3,240,484 | 3/1966 | Klamp | 49/28 |
| 3,481,074 | 12/1969 | Moss | 49/28 |

*Primary Examiner*—Paul R. Gilliam
*Assistant Examiner*—Kenneth J. Dorner
*Attorney, Agent, or Firm*—Woodhams, Blanchard and Flynn

[57] ABSTRACT

An operator for opening and closing an upwardly acting door, which operator includes an elongated rotatable drive screw having one end thereof drivingly connected to a power unit and the other end thereof disposed adjacent the upper edge of the door opening. The rotatable drive screw has a carriage engaged therewith which is slidably confined by an elongated guide rail for slidable movement therealong, which carriage is connected by a drawbar to the door for controlling the movement thereof. A floatable bearing arrangement is slidably disposed within the rail and has portions thereof positioned on opposite sides of the carriage so as to be movable along the rail in response to carriage movement, thereby providing an intermediate support for the drive screw. The drive screw is supported for limited axial movement and coacts with a control device for causing reversing of the door movement when the door strikes an obstruction when moving in its closing direction. Upon striking an obstruction, the reaction of the drive mechanism causes a slight axial movement of the screw in a direction away from the door opening, which in turn activates the control device and its associated switch for reversing the door movement. The control device is independent of the limit switches which deactivate the power unit when the door reaches its fully opened and fully closed positions.

11 Claims, 12 Drawing Figures

DOOR OPERATOR WITH SCREW DRIVE

FIELD OF THE INVENTION

This invention relates to a door operator for an upwardly acting door and, in particular, to a door operator having an improved reversing mechanism associated therewith for causing the downward movement of the door to automatically reverse if the door strikes an obstruction during its closing movement. The door operator employs an elongated drive screw arrangement supported for coaction with the reversing mechanism.

BACKGROUND OF THE INVENTION

Persons acquainted with the operation of upwardly acting doors having an electrical operator for effecting door movement are aware that some door operators have a safety switch whereby the direction of door movement is automatically reversed if the door engages an obstruction during movement in its downward or closing direction. This safety feature, as disclosed in U.S. Pat. No. 3,474,317 owned by the assignee of this application, has been provided to prevent damage to equipment and injury to personnel which might result from continued operation of the door. While operators of this type have been commercially acceptable, nevertheless they do possess structural and operational features whih have been undesirable either from a cost, maintenance or operational view point.

To improve upon operators of this type, U.S. Pat. No. 3,764,875, also owned by the Asignee of this application, discloses an operator having a mechanical override system for deactivating the safety switch when the door is within a preselected distance from either its fully opened or fully closed position to prevent reversal of the door movement. While the operator of this patent does possess the ability to deactivate the safety switch, nevertheless, this operator is structurally complex and does not possess the degree of flexibility necessary to provide for optimum control over all of the door movements.

Accordingly, copending application Ser. No. 557,929, filed Mar. 13, 1975, discloses therein a door operator having improved switch mechanism and circuitry capable of overcoming the problems and achieving the results set forth above. In particular, the control system of this operator is highly desirable with respect to the manner in which it controls the door movement when the door approaches its fully opened and fully closed positions. However, the safety or reversing switch associated with this operator is of a type which is designed primarily for use with a chain drive, and thus does not possess the optimum structural and operational characteristics for use with a door operator employing a screw drive.

Since the present invention relates to an improved door operator which utilizes a screw drive, namely an elongated drive screw for driving a carriage which is interconnected to the door, the present invention thus relates to an improved safety or reversing mechanism disposed for association with the operator to cause reversing of the door movement when the door strikes an obstruction while moving in the closing direction.

Door operators employing an elongated drive screw for controlling the opening and closing of the door are also well known, and one such operator is disclosed in U.S. Pat. No. 2,882,045. The operator of this patent employs an elongated drive screw which controls a slidable carriage, which carriage is interconnected to the door. In addition, a floatable or slidable bearing assembly is associated with the carriage and the screw to provide for additional support for the screw during movement of the carriage therealong. However, the operator of this patent has the screw resiliently urged into a central axial position, with the screw being axially movable in either direction away from this position for either stopping the door or reversing the direction thereof. In this operator, the safety or reversing switch cooperates directly with this screw to cause reversing of the door movement when the closing door strikes an obstruction. However, this direct association between the screw and the switch makes adjustment of the reversing action difficult. Also, the sensitivity of the reversing mechanism is seriously effected by the floatable mounting which permits the screw to be axially displaced in opposite directions. The direct coaction between the screw and safety switch also makes it difficult to create a sufficient force on the screw by use of a simple and compact structure so as to result in activation of the reversing mechanism at the desired force level.

The door operator of U.S. Pat. No. 2,882,045 also relies upon the opposite axial displacement of the screw for activating the limit switches which control the end positions of the door. Thus, the limit switches which control the end positions of the door, and the limit switch which controls the reversing of the door, are thus all dependent upon the same axial displacement of the screw. Independent control and adjustment of the various switch actuating functions is accordingly difficult to achieve, and thus the control functions are not always carried out under the optimum conditions relative to one another. In addition, maintaining the screw in a central axial position is particularly difficult since the weight of the door imposes a force on the screw in the same direction as the drive motor when the door is travelling downwardly, whereas the weight of the door imposes a force on the screw which is opposite to the drive force when the door is moving upwardly. This unbalance of forces on the screw thus makes maintaining of the screw in its central axial position, which position is maintained by springs, extremely difficult. The difficulty of maintaining the screw in this spring-urged central position also effects the other limit switches which control the door movement.

Accordingly, the present invention relates to a door operator which employs a drive screw for controlling the door movement, which door operator overcomes the disadvantages associated with the screw-type door operator mentioned above. In addition, the present invention provides an improved reversing mechanism adapted to coact with the door operator, particularly the screw, for permitting reversing of the door movement, which reversing mechanism is particularly suitable for use with the remainder of the control system disclosed in the above-mentioned application Ser. No. 557,929.

It is also an object of the invention to provide an improved operator, as aforesaid, wherein the safety or reversing mechanism is actuated in response to axial movement of the drive screw, with the axial movement of the drive screw functioning solely to control the reversing mechanism whereby the limit switches for controlling the end positions of the door are independent of this axial movement.

The objects of this invention, as aforesaid, are additionally accomplished by mounting the drive screw of the operator so that it is normally maintained in a preselected position, which screw is movable solely in one direction away from this position for controlling the reversing mechanism, whereby a more precise control over the screw movement is possible, while at the time permitting the door operator and particularly the drive screw and the mounting therefor to be of maximum structural and operational simplicity.

Other objects and purposes of the invention will be apparent to persons familiar with this type of equipment upon reading the following specification and inspecting the accompanying drawings.

Figure 1:
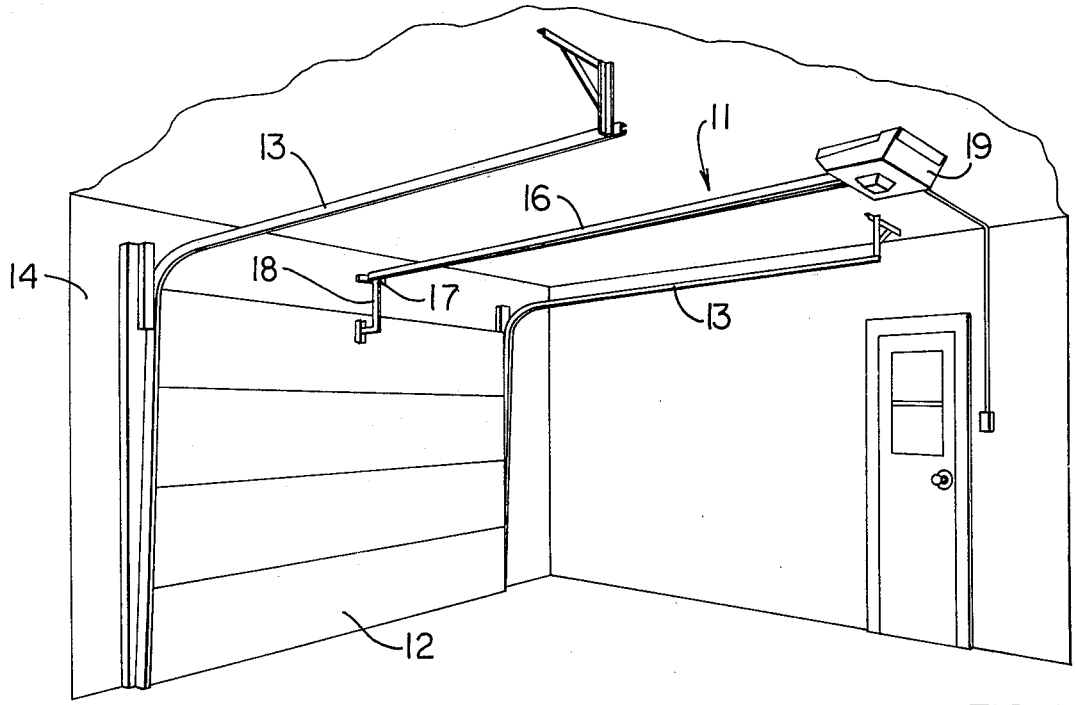
FIG. 1 is a perspective view of an upwardly acting door and of the door operator associated therewith.

For convenience in description, the terms "upper", "lower", "leftward" and "rightward"[will have reference to directions as appearing in the drawings. The words front and rear will be used to designate the structure appearing on the left and right sides, respectively, of FIGS. 1–4. The words "inwardly" and "outwardly" will refer to direction toward and away from, respectively, the geometric center of the apparatus and designated parts thereof. Said terminology will include the above-mentioned words, derivatives thereof and words of similar import.

SUMMARY OF THE INVENTION

The objects and purposes of the present invention, including those set forth above, have been met by providing a door operator having a motor drivingly connected to an elongated drive screw which is supported by bearings adjacent the opposite ends thereof. A carriage is engaged with the drive screw and is slidably supported on an elongated rail which extends substantially parallel to the screw. The carriage is interconnected to the door for moving the door in response to the reciprocating movement of the carriage. A floatable bearing assembly is slidably mounted on the rail and has bearing portions disposed on opposite sides of the carriage and positioned for supportive engagement with the screw. The floating bearing assembly is moved along the rail by the carriage to thereby provide an intermediate support for the screw. The screw is normally spring-urged toward a preselected position in which it is maintained during normal door operation. When the door strikes an obstruction during movement in the closing direction, the driving forces imposed on the screw create a force reaction which causes a slight axial movement of the screw away from the preselected position, which movement causes actuation of a reversing mechanism. The reversing mechanism includes a lever which coacts between the screw and a safety switch, which switch causes the motor and screw rotation to be reversed to thereby open the door. The lever, which is spring-urged into a position which permits normal door operation, creates a mechanical advantage which permits a small spring to create a substantial force on the screw, which force must be overcome by a relatively small displacement of the screw to cause reversing of the motor.

DETAILED DESCRIPTION

FIG. 1 illustrates therein a door operator 11 which may be manually or remotely controlled for opening and closing an upwardly acting door 12. The door 12 may be of one piece but, in the illustrated embodiment, includes several horizontally hinged sections having rollers mounted thereon for engagement with L-shaped tracks 13 for guiding the movement of the door between a substantially vertical closed position wherein it closes an opening formed in the wall 14, and a substantially horizontal open position. The structural details of the door 12 and of the tracks 13 are conventional.

The operator 11 includes an elongated horizontal beam or guide rail 16 which is of a downwardly opening, channel-shaped configuration. A carriage 17 is supported on the rail 16 for slidable movement lengthwise thereof. The carriage 17 is pivotally connected to the upper end of a drawbar assembly 18, which assembly at its lower end is connected to the door 12 in a conventional manner, as through an intermediate spring box (not shown).

To permit movement of the carriage 17 along the rail 16, the operator 11 includes a power unit 19 which is disposed adjacent the rearward end of the rail and, in the illustrated embodiment, is fixedly mounted from the ceiling. The power unit 19 includes a reversible electric motor 21 (FIG. 8) which is drivingly connected by an intermediate belt or chain 22 to a drive shaft 23, which in turn is coaxially aligned with and nonrotatably coupled to an elongated drive screw 24. A conventional sleevelike coupling 26 (FIGS. 8 and 9) fixedly connects the forward end of the drive shaft 23 to the rearward end of the drive screw 24.

The structure of the guide rail 16 and of the drive screw 24 will now be considered in detail.

The channel-shaped guide rail 16 is elongated in a substantially horizontal direction and extends substantially perpendicular to the wall 14. The rail 16 (FIGS. 3–7) is defined by a top wall 27 and a pair of substantially parallel and opposed sidewalls 28 projecting downwardly therefrom. The sidewalls 28 have a first pair of opposed flanges 29 projecting inwardly toward one another, and a similar pair of opposed flanges 31 projecting toward one another and are spaced upwardly from and substantially parallel to the flanges 29. The flanges 29 and 31 slidably accommodate therein the upper guide flanges 32 as formed on the carriage 17. The main body of the carriage, as formed by a pair of downwardly projecting, substantially parallel plates 33, projects downwardly through the elongated slot which is formed between the flanges 29. The upper end of the drawbar assembly 18 extends between the plates 33 and is hingedly connected to the carriage by a hinge bolt 34.

Carriage 17 also has a platelike latch member 36 slidably supported thereon, which latch member is urged in an upward direction by a spring 37, the latter being confined within a cylindrical housing 38. The lower end of latch member 36 has a rope or cable 39 (FIG. 2) suspended therefrom to permit manual release, that is downward movement, of the latch member 36. The purpose of latch member 36 will be explained hereinafter The rearward end of guide rail 16 has a channel-shaped bracket 41 disposed thereon, which bracket 41 is fixed to the upper wall 42 (FIG. 8) of a housing 43 associated with the power unit 19. The bracket 41 fixedly secures the rearward end of the rail 16 relative to the power unit, which power unit in turn is fixedly secured to the building, as to the ceiling thereof. The forward end of rail 16 is also fixedly secured to the building, specifically the wall 14. For this purpose, a channel-like bracket 44 (FIG. 2) is fixed to the wall 14 directly over the door opening, as by screws 46. The side flanges 47 of bracket 44 overlap the rail sidewalls 28 and are fixedly connected thereto by a bolt 48 and a pin 48A which extend completely across the rail and interconnect the flanges 47. The rail sidewalls 28 have an opening 49 formed therein, which openings align with the slots 51 in the side flanges 47 for permitting the bolt 48 to extend therethrough. The pin 48A extends through holes 49A in the sidewalls 28, which pin is forcibly inserted into holes 52 formed in the flanges 47 as by spreading the spring clips 52A.

The drive screw 24 is disposed within and extends longitudinally of the guide rail 16. The forward of screw 24 is rotatably supported by a fixed bearing block 56 which is disposed within the interior of the rail and is fixed with respect to the rail, as by screws 57. The bearing block 56 is substantially rectangular in cross section so as to be supported within and closely confined by the guide rail. The bearing block has a cylindrical opening extending therethrough which is of a diameter slightly larger than the maximum diameter of the drive screw 24 so as to provide a rotatably bearing support for the screw.

The rearward end of guide rail 16 has a similar bearing block 58 disposed therein and fixed to the rail by screws 59. Bearing block 58 is identical to the front bearing block 56 and provides a rotatable bearing support for the rearward end of the screw 24.

The drive screw 24 is disposed in engagement with a nut assembly 60 which includes a pair of identical nuts 61 and 62. Each nut 61 and 62 is formed by substantially square or rectangular hollow shell 63 (FIG. 5), which shell 63 has a pair of top runners 64 disposed adjacent the upper corners thereof and confined by the upper corners of the guide rail. Similar bottom runners 66 are provided on the shell 63 and positioned for slidable engagement with the flanges 31.

Figure 5:
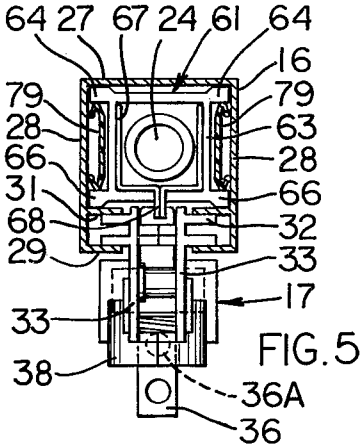
FIGS. 5 and 6 are cross-sectional views taken respectively along the lines V—V and VI—VI in FIG. 4.

The two nuts 61 and 62 are fixedly joined together in spaced relationship by means of a U-shaped element 67 extending rigidly therebetween, which U-shaped element 67 partially surrounds the drive screw 24 as shown in FIG. 5. The element 67 has a platelike flange 68 projecting downwardly therefrom, which flange defines a pair of oppositely sloped, downwardly directed camming surfaces 69. A recess or slot 71 is formed in the flange 68 substantially at the midpoint between the camming surfaces 69 so as to receive therein the upper end of the latch member 36, thereby locking the nut assembly 60 and the carriage 17 together.

Each of the nuts 61 and 62 has a threaded opening extending therethrough and disposed in threaded engagement with the drive screw 24 so that rotation of the drive screw 24 will cause a linear slidable displacement of the nut assembly 60 along the guide rail 16.

To provide additional bearing support for the drive screw 24, particularly due to the load imposed thereon by the nut assembly 60, there is provided a floating bearing assembly 72 which includes a pair of identical bearing blocks 73 and 74 positioned on opposite sides of the nut assembly 60 and slidably supported by the guide rail 16. Each of the bearing blocks 73 an 74 have upper and lower runners 76 and 77, respectively, which slidably support the blocks within the guide rail. The bearing blocks 73 and 74 also have a sleevelike bearing portion 78 defining therein an opening which is of a diameter slightly larger than the maximum diameter of the screw 24, whereby the screw projects through this opening and is rotatably supported by the bearing block.

Figure 3:
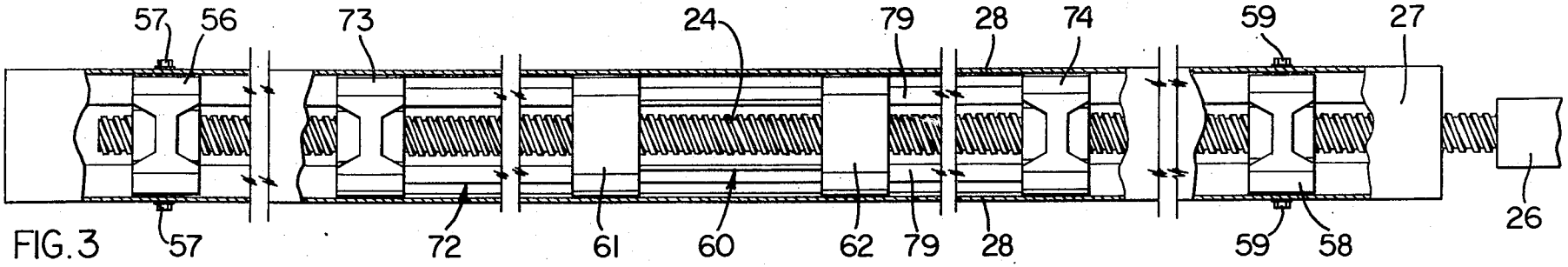
FIG. 3 is a fragmentary bottom view of the screw portion of the operator, same being taken partially in cross section.
Figure 4:
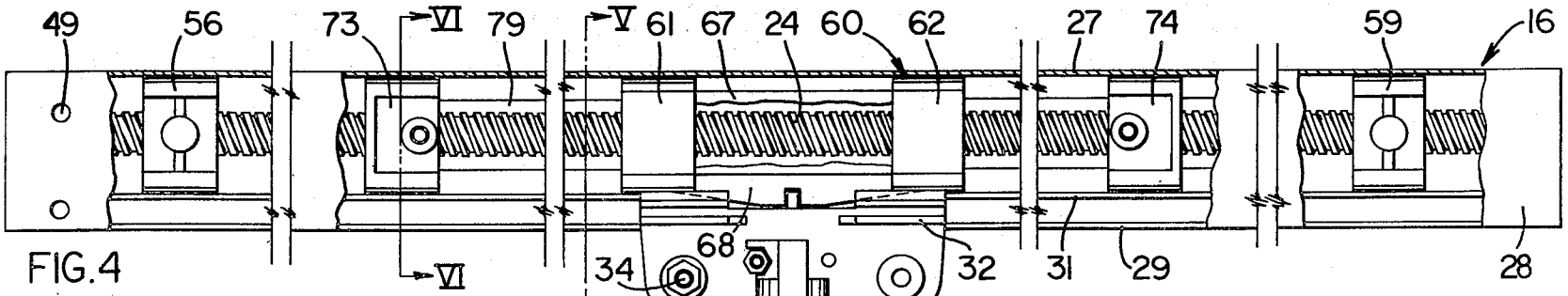
FIG. 4 is a broken, elevational view of the screw portion of the operator, a part thereof appearing in cross section.
Figure 6:
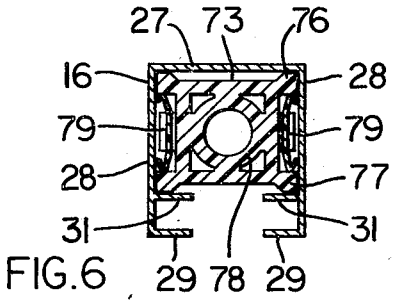
Figure 7:
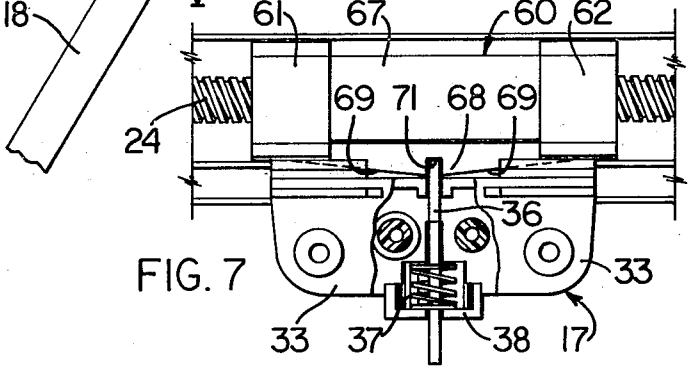
FIG. 7 illustrates the attachment of the carriage to the screw operator, which carriage has been partially broken away for clarity of illustration.

The two bearing blocks 73 and 74 are fixedly interconnected by a pair of connecting strips 79 which, as illustrated in FIG. 6, are of a channel-shaped cross section. The strips 79 have the opposite ends thereof fixedly connected to the bearing blocks 73 and 74, whereas intermediate portions of the strips 79 pass through suitable clearance spaces formed in the sides of the nuts 61 and 62, as shown in FIG. 5, so that the nut assembly 60 and the bearing assembly 72 can slide relative to one another in the longitudinal direction of the guide rail. As indicated in FIGS. 3 and 4, the slidable bearings 73 and 74 are spaced apart by a distance which is substantially greater than the spacing between the nuts 61 and 62, so that the nut assembly 60 is thus capable of being slidably displaced through a distance equal to the spacing between the bearings 73 and 74, less the length of the nut assembly, without causing a corresonding displacement of the bearing assembly.

Figure 8:
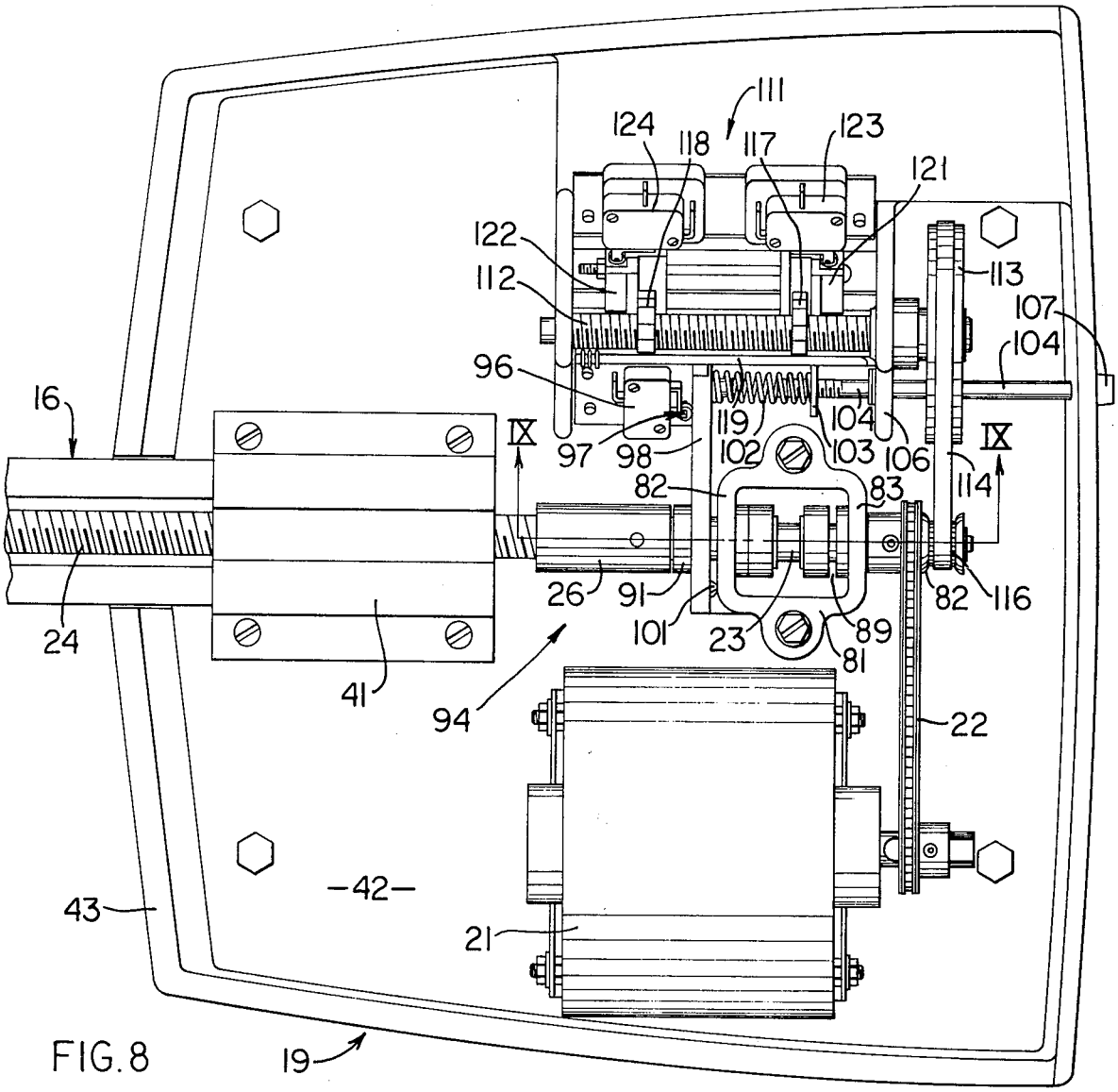
FIG. 8 is a bottom view of the power unit (with the cover removed) for driving and controlling the movement of the screw.
Figure 9:
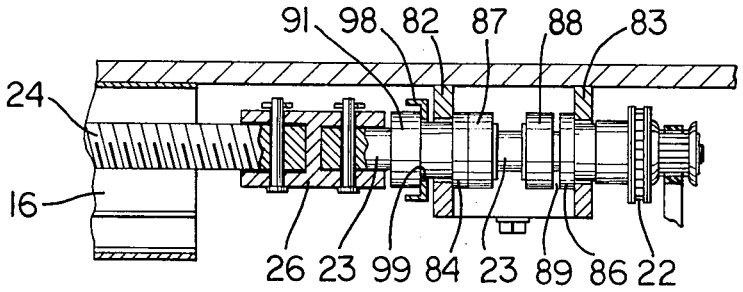
FIG. 9 is a fragmentary sectional view taken along the line IX—IX in FIG. 8.

Considering now the drive shaft 23, and referring specifically to FIGS. 8 and 9, the shaft 23 is supported on a bracket 81 which is fixed to the housing 43 and includes a pair of opposed support walls 82 and 83 provided with openings through which project the drive shaft 23. The walls 82 and 83 have suitable bearings 84 and 86 associated therewith, which bearings provide rotatable support for the shaft 23 while enabling limited axial displacement of the shaft relative to the bearings. The shaft is provided with a pair of collars 87 and 88 fixedly secured thereto, which collars are disposed between the bearings 84 and 86 but are spaced apart by a distance slightly less than the spacing between the bearings, as indicated by the clearance space 89.

The forward end of the drive shaft 23 projects through the wall 82 and has a thrust bearing 91 fixed thereto, which bearing is spaced a preselected distance from the adjacent wall 82. The rearward end of the drive shaft similarly projects through and beyond the other wall 83 and is provided with a drive sprocket or pulley 92 fixedly secured thereto, which sprocket or pulley is engaged with the chain or belt 22.

Clearance space provided between the bearing 91 and the wall 82, together with the clearance space 89, permits the drive screw 24 and drive shaft 23 to be axially shifted rearwardly (rightwardly in the drawings) a limited extent, such as approximately 3/16 of an inch. However, the drive shaft 23 and drive screw 24 are normally maintained in the position illustrated in the drawings, in which position the drive shaft 23 and drive screw 24 are prevented from moving axially forward (leftwardly in the drawings) due to the engagement of the collar 87 with the bearing 84.

The door operator, and specifically the power unit 19, is provided with a safety or reversing mechanism 94 (FIGS. 8 and 9) for causing the movement of the door, and hence the rotation of the drive screw and motor, to be reversed when the door encounters an obstruction when moving in a closing direction. This reversing mechanism includes a conventional limit switch 96 which, when opened, reverses the energization of the motor 21 to thereby reverse the rotation thereof. This limit switch 96 is mounted within the power unit housing 43 and has the actuator 97 thereof disposed for actuation by one end of a reversing lever 98. The reversing lever 98 has an opening 99 formed therethrough adjacent the other end thereof, which opening receives therein the drive shaft 23 and its associated bearing. A projecting or fulcrum 101 is fixed to the free end of the lever 98 in the vicinity of the drive shaft 23, which projection 101 bears against the wall 82.

The other end of reversing lever 98 is engaged by one end of a compression spring 102, which spring is confined between the lever 98 and an adjustable nut 103 as fixed adjacent the free end of a control rod 104. The control rod 104 is supported within a stationary wall 106 so that rotation of the rod 104 will cause an axial displacement of the nut 103, whereby the position of nut 103 can be adjusted to accordingly vary the compression of the spring 102. The end of rod 104 projects outwardly through the wall of the housing 43 and is provided with a knob 107 so as to permit the compression of spring 102 to be selectively adjusted from a location disposed externally of the power unit housing.

To provide for stopping of the door operator when the door 12 reaches its fully closed or fully opened positions, the power unit 19 has associated therewith a control means 111 which includes a rotatable control screw 112 supported for rotation on the housing and drivingly connected to the drive motor 21. For this purpose, screw 112 has a toothed pulley 113 thereon which is in driving engagement with a toothed drive belt 114, which in turn is driven by a driving pulley 116 fixed on the drive shaft 23.

The control screw 112 has two control nuts 117 and 118 disposed in engagement therewith, which nuts are prevented from rotating by means of a rod 119. The control nuts cooperate with slides 121 and 122 which can be slidably displaced axially of the control screw, which slides 121 and 122 respectively control and cause actuation of suitable limit switches 123 and 124. These limit switches cause deenergization of the motor 21 when the door reaches either its fully opened or fully closed position.

The structural and operational details of the control means 111, including the electrical circuitry therefor, is disclosed in above-mentioned copending application Ser. No. 557,929. This copending application also includes therein the circuitry for the reversing limit switch 96, so that further detailed description of this portion of the reversing mechanism is not believed necessary.

OPERATION

While the operation of the present invention is believed apparent from the above description, nevertheless same will be briefly described to ensure a complete understanding thereof.

During normal operation of the door assembly, such as when the door is in an open overhead position, energization of motor 21 causes rotation of screw 24, whereby carriage 17 is moved forwardly along the guide rail 16 until the door is moved downwardly into a closed position. During movement of the door in its closing direction, the screw 112 associated with the control means 111 is also rotated whereby the nuts 117 and 118 linearly advance along the control screw, wtih the nut 118 coacting with the slide 122 to actuate the limit switch 124 when the door approaches and reaches is closed position, whereby the limit switch 124 deenergizes the motor 21. Similarly, when opening of the door is desired, motor 21 is again energized and rotates in a reverse direction, causing a reverse rotation of screw 24 so that carriage 17 is moved rearwardly along the rail 16, thereby moving the door into its open position. During this opening movement of the door, the control screw 112 is rotated in a reverse direction so that nut 117 and slide 121 coact with the limit switch 123 for deenergizing motor 21 when the door reaches a fully open position. This operation of the door, and the coaction with limit switches for deenergizing the driving motor at the closed or opened positions, is conventional.

When the door is in its fully open position, the nut assembly 60 is disposed closely adjacent the floating bearing block 74, which in turn is disposed closely adjacent the fixed bearing block 58. The other floating bearing block 73 is spaced forwardly a substantial distance from the nut assembly. When motor 21 is energized to cause forward movement of carriage 17 and nut assembly 60 along the guide rail 16, the assembly 60 moves along the guide track until engaging the front floating bearing 73, at which time the floating bearing assembly 72 moves synchronously along the guide rail until reaching a position adjacent the forward end thereof, as determined by the door being in a closed position. In this manner, the floating bearing assembly provides for support of the screw 24 at a location which is disposed intermediate the fixed bearings 56 and 58, particularly by supporting the screw closely adjacent and on opposite sides of the carriage 17.

Similarly, when the door is in its closed position, the nut assembly 60 is disposed closely adjacent the front fixed bearing 56, with the front floating bearing 73 being disposed there-between. During the initial rearward movement of the carriage 17 for causing opening of the door, the bearing assembly 72 remains stationary until the nut assembly 60 engages the rear floating bearing 74, at which time the bearing assembly 72 will move synchronously along the guide rail 16 until the door reaches its fully opened position.

In situations where it is desirable or necessary to manually operate the door, such as due to a power or motor failure, same can be accomplished by pulling downwardly on the cable 39, thereby releasing the latch 36 from the slot 71. The door can then be moved upwardly or downwardly since the carriage 17 is disengaged from the nut assembly 60. However, when it is desired to re-engage the carriage 17 with the nut assembly 60, same can be accomplished by driving the nut assembly toward the carriage 17, whereupon the cam surface 69 engages the latch plate 71 and cams same downwardly. The spring 37 then urges the latch member 36 upwardly into the slot 71 when properly aligned therewith.

If desired, latch 36 can be locked in its released position. For this purpose, latch 36 has a hole 36A therein which is positioned below the housing 38 when latch 36 is pulled downwardly into its released position. Hole 36A accommodates therein a removable lock pin (not shown).

The operation of the reversing mechanism 94 will now be considered. When the door is being moved downwardly, the drive screw 24 is urged axially in a forward direction due to the spring 102 which acts against the reversing lever 98, which in turn pivots about the projection or fulcrum 101 so that lever 98 bears against the bearing 91. Due to this spring force, screw 24 is maintained in a forwardmost position defined by the engagement of the collar 87 with the bearing 84. The biasing force imposed on screw 24 and drive shaft 23 is substantially larger than the spring force 102, being equal to the spring force 102 multiplied by the ratio of the levers as measured about the folcrum 101, that is the ratio of the perpendicular distance between the center line of the spring 102 and the folcrum 101, divided by the perpendicular distance between the center line of the screw 24 and the fulcrum 101. The lever 98 thus creates a mechanical advantage which results in the biasing force imposed on the screw 24 being several times larger than the force generated by the spring 102.

When the door strikes an obstruction when moving in a closing direction, such as the door striking a vehicle or similar object which prevents further downward movement of the door, a reaction force is imposed on the screw 24 due to the continual driving of the screw by the motor 21. This reaction force causes the screw 24 to move axially rearwardly in opposition to the biasing force imposed thereon by the spring 102 and lever 98. The rearward axial movement of the screw 24, as permitted by the clearance space 89, results in the lever 98 pivoting about the fulcrum 101 (clockwise in FIG. 8) in opposition to the urging of the spring 102, whereupon the actuator 97 of limit switch 96 is urged outwardly due to the internal spring structure thereof, thus causing actuation of switch 96 which in turn causes a reversal in the energization of motor 21 so that same is reversely rotated. The carriage 17 is accordingly moved axially rearwardly of the guide rail and moves the door 12 in an opening direction.

In view of the relatively small lever arm which exists between the fulcrum 101 and the center line of the screw 24, in contrast to the rather large lever arm which exits between the spring 102 and the fulcrum 101, an extremely small rearward axial movement of the screw 24 results in a larger movement of the lever 98 where same is contacted by the switch actuator 97, thereby permitting proper actuation of the switch 96 while requiring only an extremely small axial movement of the drive screw 24. Further, the mechanical advantage created by these different levers also permits a relatively small spring 102 to be utilized while still providing an urging force of a desirable magnitude on the drive screw. At the same time, the externally accessible knob 107 can be easily adjusted to permit simple variation in the magnitude of the spring force, thereby in turn permitting adjustment in the urging force imposed on the drive screw. The extremely small rearward movement of the drive screw required for causing reversing of the motor, when coupled with the rather large urging force which must be overcome in order to move the screw rearwardly, which factors result from the mechanical advantage created by the lever 98, thus make the reversing mechanism 94 extremely sensitive upon striking an obstruction. Thus, a prompt reversal in the driving of the door carriage occurs when the door strikes an obstruction when moving in a closing direction.

MODIFICATION

Figure 2:
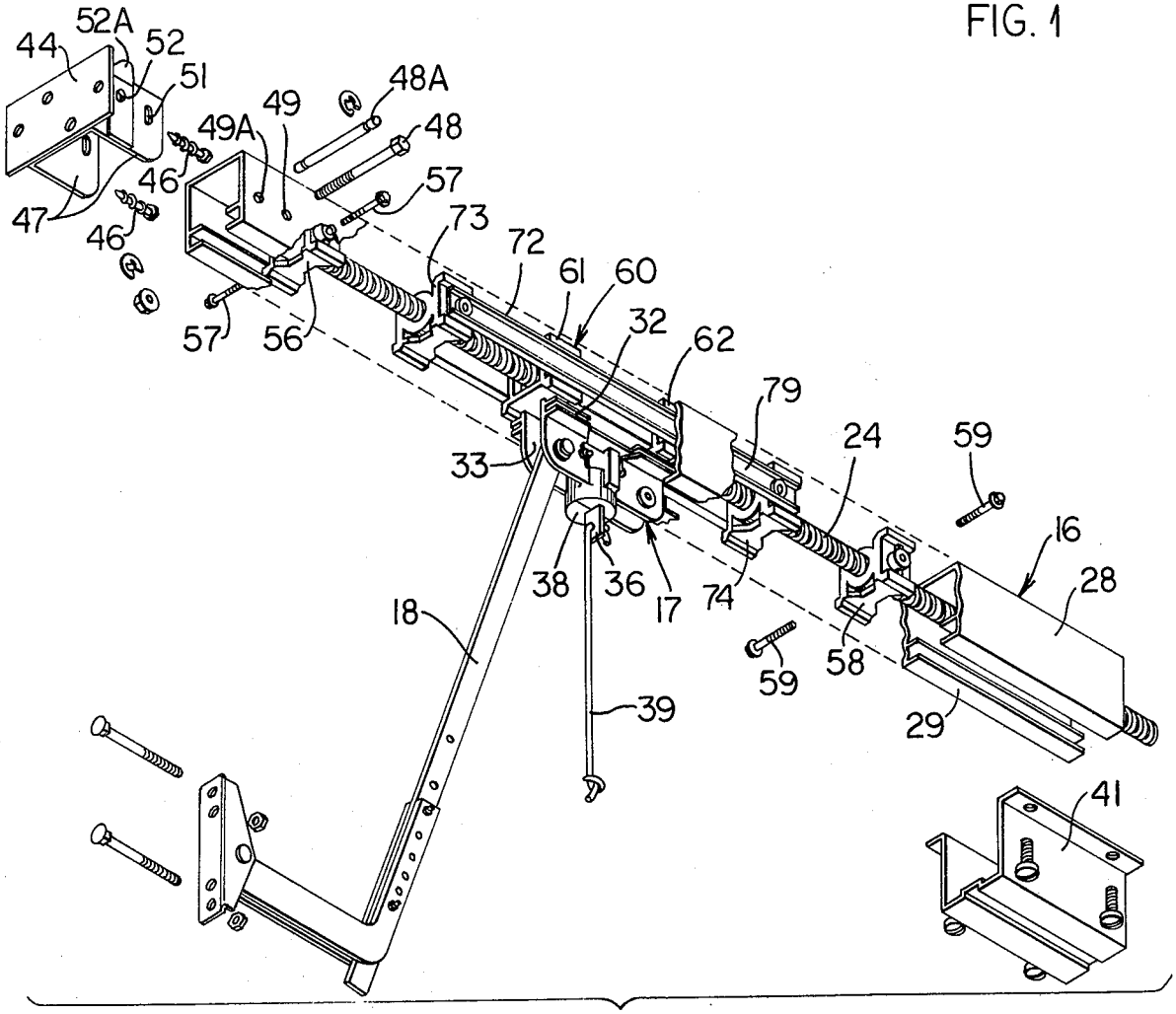
FIG. 2 is an exploded, perspective view of the drive screw portion of the door operator, parts of which have been broken away for clarity of illustration.
Figure 10:
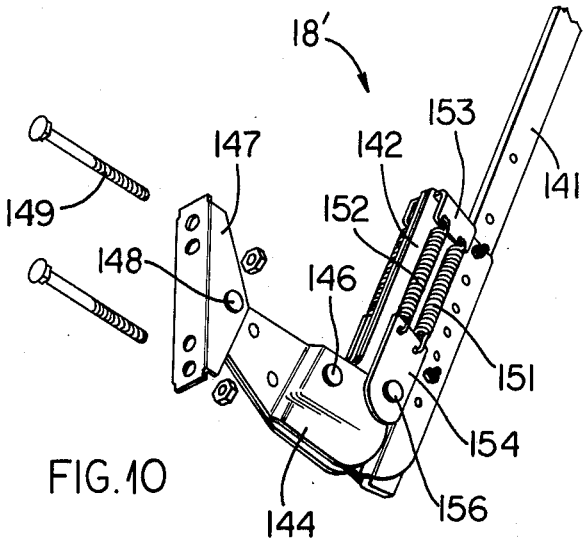
FIG. 10 is an exploded, perspective view of an improved drawbar assembly for connection to the door.
Figure 11:
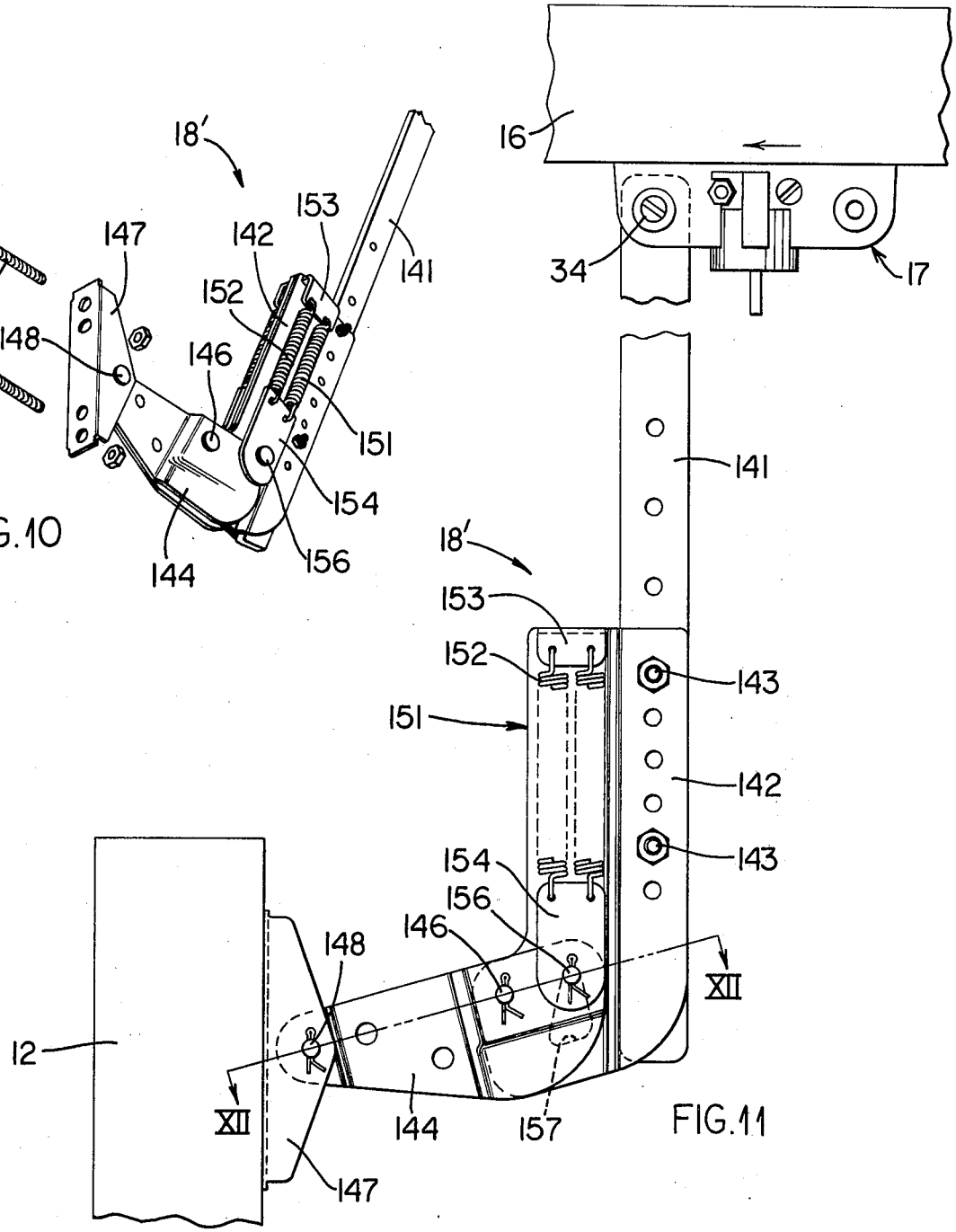
FIG. 11 is an elevational view of the improved drawbar assembly.
Figure 12:
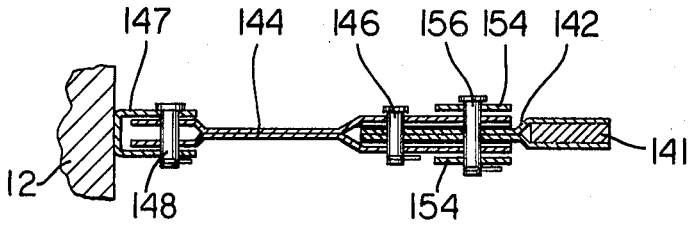
FIG. 12 is a sectional view along line XII—XII in FIG. 11.

FIGS. 10–12 illustrate therein a modified drawbar assembly 18' which can be substituted for the drawbar assembly 18 illustrated in FIG. 2.

The assembly 18' includes an elongated arm 141 which has the upper end thereof pivotally connected to the carriage 17, as by a pivot pin or bolt 34. Arm 141 has a yoke-shaped frame 142 fixed thereto by bolts 143. The frame 142 and arm 141 have a plurality of openings therein for accommodating the bolts 143, thereby permitting the frame to be selectively mounted on the arm in several different positions.

A yoke-shaped lever 144 is pivotally connected to the lower end of frame 142 by a pivot pin 146. The other end of lever 144 is connected to a door bracket 147 by a pivot pin 148, which bracket 147 in turn is adapted to be fixedly secured to the door 12, as by bolts 149.

A spring unit 151 is provided for resiliently connecting the lever 144 to the frame 142. For this purpose, a top bracket 153 is fixed to the frame 142 adjacent the upper end thereof. A pair of conventional tension-type coil springs 152 have their upper ends anchored to the bracket 153, and the lower ends of the springs are anchored to a lower bracket 154. The lower bracket 154 is in turn pivotally connected to the lever 144 by a pivot pin 156 which is spaced from the pivot pin 146. Pin 156 extends through slot 157 formed in the frame 142, whereby pin 156 and slot 157 thus form a lost-motion connection between frame 142 and lever 144 for limiting the relative movement therebetween.

While the drawings illustrate the spring unit 151 as having a pair of springs 152 disposed on one side of the frame 142, a further pair of identical springs are similarly mounted on the other side of the frame.

By using the drawbar assembly 18', the carriage 17 when moving in a door closing direction (as indicated by the arrow in FIG. 11) can continue to move even after the door 12 has stopped, whereupon the continued movement of the carriage 17 will thus permit activation of the limit switch which deenergizes the motor when the door is closed. This is particularly significant in situations where snow, ice mud or the like covers the driveway directly beneath the door, which snow or other covering may be up to approximately two inches high. When the door strikes this covering and is prevented from moving further downwardly, the door is thus effectively closed even though the carriage 17 must still undergo several additional inches of travel in order to engage the limit switch which deactivates the motor in the normal closed position of the door. The presence of the spring unit 152 for interconnecting the frame 142 to the lever 144 accordingly permits this necessary additional travel of the carriage 17, even though the door 12 is stopped, since the relative movement between the carriage 17 and the door 12 will accordingly be compensated for by the permissible pivotal movement between the lever 44 and the frame 142, which pivotal movement causes a corresponding elongation of the springs 152.

The drawbar assembly 18' is also desirable since, when the door is in an open position, the spring unit 151 provides a cushioning effect between the carriage 17 and the door 12 during startup of the operator. The drawbar assembly 18' is also advantageous in view of the adjustment which is provided due to the manner in which the frame 142 is releasably attached to the arm 141 in one of several different positions.

Although a particular preferred embodiment of the invention has been disclosed in detail for illustrative purposes, it will be recognized that variations or modifications of the disclosed apparatus, including the rearrangement of parts, lie within the scope of the present invention.

The emdodiments of the invention in which an exclusive property or privilege is claimed are defined as follows:

1. In a door operator for moving a door between a closed position wherein the door extends substantially vertically and closes a door opening and an open position wherein the door extends substantially horizontally and is disposed adjacent the upper edge of the door opening, said operator including elongated screw means extending in a substantially horizontal direction away from the door opening, bearing means for supporting said screw means for rotation about the longitudinally extending axis thereof, said bearing means also supporting said screw means for limited displacement in the axial direction thereof, carriage means engaged with said screw means and movable axially therealong in response to rotation of said screw means, said carriage means having means thereon adapted for engagement with the door, motor means drivingly interconnected to said screw means for selectively rotating same in either rotational direction, whereby rotation of said screw means in a first rotational direction causes linear movement of said carriage means in one axial direction along said screw means so that said door is moved in a closing direction, whereby rotation of said screw means in a second rotational direction opposite said first direction causes linear movement of said carriage means in the other axial direction along said screw means for moving said door in an opening direction, and reversing means cooperating with said screw means for causing the rotational direction of said screw means to be automatically reversed when said screw means is rotating in said first rotational direction due to said door striking an obstruction when moving in said closing direction, whereby said reversing means causes the door to be automatically moved in an opening direction, the improvement comprising:

stop means coacting with said screw means for preventing axial movement of said screw means in said one axial direction away from a preselected position, said stop means permitting axial movement of said screw means away from said preselected position in said other axial direction;

said reversing means including biasing means coacting with said screw means and urging same in said one axial direction for normally maintaining said screw means in said preselected position, said reversing means also including switch means associated with said motor means for reversing the rotation of said screw means when same is rotating in said first rotational direction; and connecting means for causing actuation of said switch means in response to axial movement of said screw means in said second axial direction away from said preselected position.

2. An operator according to claim 1, wherein said connecting means includes link means extending between and movably coacting with said screw means and said switch means, said link means causing the axial movement of said screw means away from said preselected position to be magnified for causing actuation of said switch means.

3. An operator according to claim 2, wherein said link means comprises lever means connected between said screw means and said switch means, said switch means engaging said lever means at a first point thereon, said screw means engaging said lever means at a second point thereon, and said lever means being mounted for pivoting movement about a third point, the distance between said second and third points being substantially less than the distance between said first and third points so that the axial displacement of said screw means is magnified when transferred to said switch means for causing actuation thereof.

4. An operator according to claim 3, wherein said biasing means including spring means cooperating with said lever means for normally urging same in one rotational direction about said third point which is opposite to the direction of displacement of said lever means when moved due to axial displacement of said screw means, said spring means engaging said lever means at a fourth point which is spaced from said third point by a distance which is greater than the spacing between said second and third points so that the magnitude of the spring force imposed on said lever means is magnified when imposed on said screw means for urging same into said preselected position.

5. An operator according to claim 4 wherein said lever means comprises an elongated lever which extends substantially perpendicular to the axis of said screw means and is mounted for swinging movement in a plane which is substantially parallel to the axis of said screw means, said lever having said third point located adjacent one end thereof, said lever having said first and fourth points located adjacent the other end thereof, and said second point being disposed intermediate the ends of said lever.

6. An operator according to claim 5, wherein the intermediate portion of the lever has an opening extending therethrough, said screw means projecting through said opening, abutment means cooperating between said screw means and said lever, and said spring means normally urging said lever about said third point to thereby maintain said lever in a selected position wherein said abutment means are in engagement to prevent further rotation of said lever in said one rotational direction.

7. An operator according to claim 1, wherein said bearing means includes first and second stationary support bearings disposed adjacent the opposite ends of said screw means for rotatably supporting same, said support bearings permitting limited axial displacement of said screw means; and elongated guide rail means disposed adjacent said screw means and extending substantially parallel therewith, said guide rail means having said carriage means disposed in slidable engagement therewith for guiding said carriage means as it linearly moves longitudinally along said screw means.

8. An operator according to claim 7, including movable bearing means for supporting said screw means at a location intermediate the ends thereof as said carriage moves along said screw means, said movable bearing means having a bearing portion slidably engaged with said guide rail means and disposed for supportive engagement with said screw means, said bearing portion being moved in response to movement of said carriage means along said screw means.

9. An operator according to claim 8, wherein said movable bearing means includes a pair of said bearing portions disposed in supportive engagement with said screw means and slidably engaged with said guide rail means, said pair of bearing portions being fixedly interconnected but spaced from one another in the axial direction of said screw means, and said carriage means including nut means disposed in threaded engagement with said screw means, said nut means being positioned between said pair of bearing portions.

10. An operator according to claim 7, wherein said carriage means includes a nut assembly disposed in threaded engagement with said screw means and a carriage assembly slidably supported on said guide rail means, said carriage means also including releasable latch means coacting between said nut assembly and said carriage assembly for fixedly connecting same together for synchronous movement along said screw means in response to rotation thereof, said releasable latch means including a movable latch member movably supported on one of said assemblies and spring-urged into engagement with the other of said asemblies for normally latching said assemblies together, said latch means also including a manual actuator interconnected to said latch member for manually releasing same to disconnect said carriage assembly from said nut assembly.

11. An operator according to claim 10, wherein said other assembly has first and second cam means formed theron and disposed for engagement with said latch member when said assemblies are disengaged but are relatively slidably moved toward one another for causing said latch member to be cammed into engagement with said one assembly to automatically fixedly connect said assemblies together for synchronous linear movement.

* * * * *